US010271671B2

(12) United States Patent
Ramzan

(10) Patent No.: US 10,271,671 B2
(45) Date of Patent: Apr. 30, 2019

(54) BEVERAGE CONTAINER LID

(71) Applicant: Chaudhary M. Ramzan, Orange, CT (US)

(72) Inventor: Chaudhary M. Ramzan, Orange, CT (US)

( * ) Notice: Subject to any disclaimer, the term of this patent is extended or adjusted under 35 U.S.C. 154(b) by 0 days.

(21) Appl. No.: 14/842,372

(22) Filed: Sep. 1, 2015

(65) Prior Publication Data

US 2016/0100704 A1 Apr. 14, 2016

Related U.S. Application Data

(60) Provisional application No. 62/084,498, filed on Nov. 25, 2014.

(51) Int. Cl.

| | |
|---|---|
| ***A47G 19/22*** | (2006.01) |
| ***B65D 43/02*** | (2006.01) |
| ***B65D 51/24*** | (2006.01) |

(52) U.S. Cl.

CPC ..... *A47G 19/2288* (2013.01); *A47G 19/2272* (2013.01); *B65D 43/0212* (2013.01);

(Continued)

(58) Field of Classification Search

CPC ..... A47G 19/2272; A47G 19/2288; B65D 43/0212; B65D 47/04; B65D 47/06; B65D 47/12; B65D 47/14; B65D 51/24; B65D 2205/02; B65D 2543/00046; B65D 2543/00092; B65D 2543/00537;

(Continued)

(56) References Cited

U.S. PATENT DOCUMENTS

| | | | |
|---|---|---|---|
| 2,943,794 | A | 7/1960 | Sussman |
| 4,619,372 | A | 10/1986 | McFarland |

(Continued)

FOREIGN PATENT DOCUMENTS

| | | | |
|---|---|---|---|
| EP | D 327 244 | A1 | 8/1989 |
| WO | 2013/122371 | A1 | 8/2013 |

(Continued)

OTHER PUBLICATIONS

International Search Report and Written Opinion for PCT Serial No. PCT/US15/60113 dated Jan. 15, 2016.

(Continued)

*Primary Examiner* — James N Smalley
*Assistant Examiner* — Madison L Poos
(74) *Attorney, Agent, or Firm* — McCormick, Paulding & Huber LLP

(57) ABSTRACT

A beverage container lid for dispersing heat includes a cover portion having an inlet opening and forming a dispensing spout. The dispensing spout has one or more dispensing sides that rise upwardly from the cover and form a mixing chamber with a dispensing opening and fluidly connected to the inlet opening. The dispensing sides have one or more side perforations for allowing air to enter the mixing chamber. At least some of the beverage contained in an interior chamber of a cup is drawn into the inlet opening, mixed with air in the mixing chamber, and dispensed by the dispensing opening such that the at least some of the beverage has a lower temperature than the beverage contained in the interior chamber of the cup.

19 Claims, 8 Drawing Sheets

(52) U.S. Cl.
CPC ..... *B65D 51/24* (2013.01); *B65D 2205/02* (2013.01); *B65D 2543/00046* (2013.01); *B65D 2543/00092* (2013.01); *B65D 2543/00537* (2013.01); *B65D 2543/00638* (2013.01); *B65D 2543/00685* (2013.01); *B65D 2543/00731* (2013.01); *B65D 2543/00796* (2013.01)

(58) Field of Classification Search
CPC ..... B65D 2543/00638; B65D 2543/00731; B65D 2543/00796; B65D 2547/06; B65D 2547/063; B65D 2547/066
USPC ..... 220/711, 703, 705, 713, 719
See application file for complete search history.

(56) References Cited

U.S. PATENT DOCUMENTS

| | | | | |
|---|---|---|---|---|
| 4,915,250 | A | 4/1990 | Hayes | |
| 5,538,156 | A | 7/1996 | Proshan | |
| 6,164,470 | A | 12/2000 | Chino | |
| 6,176,390 | B1 | 1/2001 | Kemp | |
| 6,905,044 | B1 | 6/2005 | Russo et al. | |
| 7,147,126 | B2 * | 12/2006 | Samson ..... | A47G 19/2272 220/711 |
| 7,537,173 | B1 | 5/2009 | Kogan | |
| 7,591,393 | B2 | 9/2009 | Crudgington, Jr. | |
| 7,954,659 | B2 | 6/2011 | Zuares et al. | |
| 7,959,028 | B2 | 6/2011 | Leon | |
| 8,025,242 | B2 | 9/2011 | Efremkin et al. | |
| 8,851,324 | B2 | 10/2014 | O'Sullivan | |
| 2005/0205588 | A1 | 9/2005 | Pitts | |
| 2007/0062942 | A1 | 3/2007 | Samson et al. | |
| 2008/0305226 | A1 | 12/2008 | Catena et al. | |
| 2009/0041904 | A1 | 2/2009 | Baron | |
| 2009/0108006 | A1 | 4/2009 | Milan | |
| 2009/0223981 | A1 | 9/2009 | Levy | |
| 2009/0294460 | A1 | 12/2009 | Hovsepian et al. | |
| 2014/0103037 | A1 | 4/2014 | Strominger | |
| 2015/0014322 | A1 | 1/2015 | Kim | |
| 2015/0353240 | A1 | 12/2015 | Nelms | |

FOREIGN PATENT DOCUMENTS

| | | | |
|---|---|---|---|
| WO | 2014/165729 | A1 | 10/2014 |
| WO | 2016174108 | A1 | 3/2016 |

OTHER PUBLICATIONS

International Search Report and Written Opinion for PCT Serial No. PCT/US17/61347 dated Feb. 9, 2018.

Supplementary European Search Report for Serial No. EP 15 86 3697 dated Apr. 30, 2018.

* cited by examiner

BEVERAGE CONTAINER LID

CROSS-REFERENCE TO PRIOR APPLICATION

This application claims priority to and incorporates by reference provisional application 62/084,498 filed Nov. 25, 2014.

TECHNICAL FIELD

The present invention relates generally to beverage containers and, more particularly, to beverage container lids.

BACKGROUND

Traditional beverage containers include a cup with an attached lid to contain and facilitate consumption of a beverage. The lid typically includes a cover portion with a hole therein to allow drinking, while preventing the beverage from spilling out of the cup. Some beverages are best consumed at hot temperatures. However, a beverage contained in a traditional beverage container may have a temperature hot enough to burn, scald or cause other injuries to a consumer drinking the beverage. Thus, it is often desirable to partially cool the beverage prior to being consumed. One approach to cooling the beverage is to remove the lid from the cup, thereby allowing the beverage to cool. However, when the lid is removed from the cup, the lid cannot prevent the beverage from spilling out of the cup. Further, exposing the beverage directly to the atmosphere may cool the beverage too much and too quickly, thereby shortening the length of time the beverage remains hot. Therefore, there is a need for an improved approach to consuming hot beverages.

SUMMARY

A beverage container lid for dispersing heat includes a cover portion having an inlet opening and forming a dispensing spout. The dispensing spout has one or more dispensing sides that rise upwardly from the cover portion and form a mixing chamber with a dispensing opening. The dispensing sides may have one or more side perforations for allowing air to enter the mixing chamber. The beverage container lid is secured to an open top of a beverage container having an interior chamber that contains a beverage. At least some of the beverage contained in the interior chamber of the beverage container is drawn into the inlet opening, is mixed with air in the mixing chamber, and is dispensed by the dispensing opening such that the at least some of the beverage has a lower temperature than the beverage contained in the interior chamber of the beverage container.

These and other objects, features and advantages of the present invention will become apparent in light of the following description of non-limiting embodiments, with reference to the accompanying drawings.

DETAILED DESCRIPTION

Figure 1:
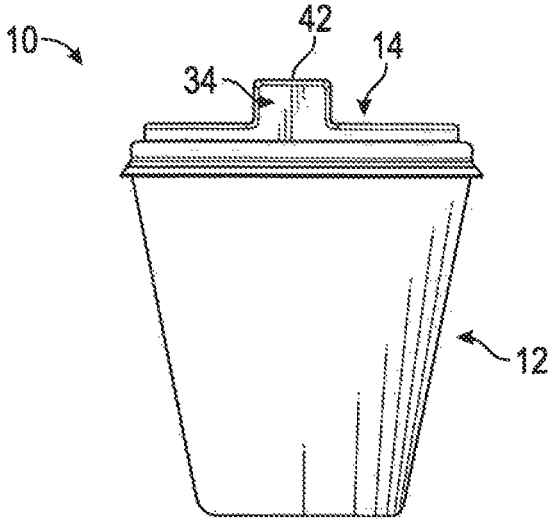
FIG. 1 is a side view of a beverage container and lid.
Figure 2:
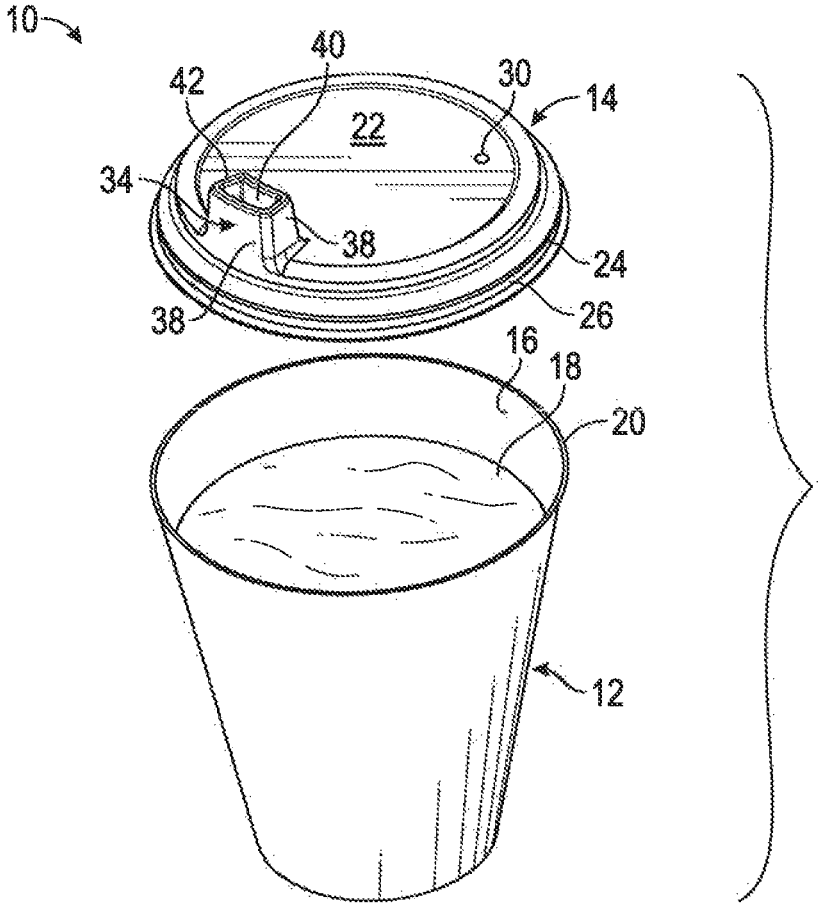
FIG. 2 is an exploded perspective view of the beverage container and lid of FIG. 1.

Referring to FIGS. 1 and 2, a beverage container 10 includes a cup 12 and a lid 14 for securely closing the cup 12. The cup 12 includes an interior chamber 16 for housing a liquid or beverage 18 therein and a rolled lip 20 encircling the top of the cup 12 for engaging the lid 14. The lid 14 includes a cover portion 22 for covering the interior chamber 16 of the cup 12 and a flange 24 extending downwardly from the cover portion 22 to engage the rolled lip 20 of the cup 12. The flange 24 includes geometry 26 to securely mate with the rolled lip 20 of the cup 12 to form a tight engagement therebetween. The lid 14 may include a vent 30 formed therein and a spout 34 extending upwardly therefrom. The spout 34 includes spout sides 38 forming a mixing chamber 40 and a dispensing opening 42.

Figure 3:
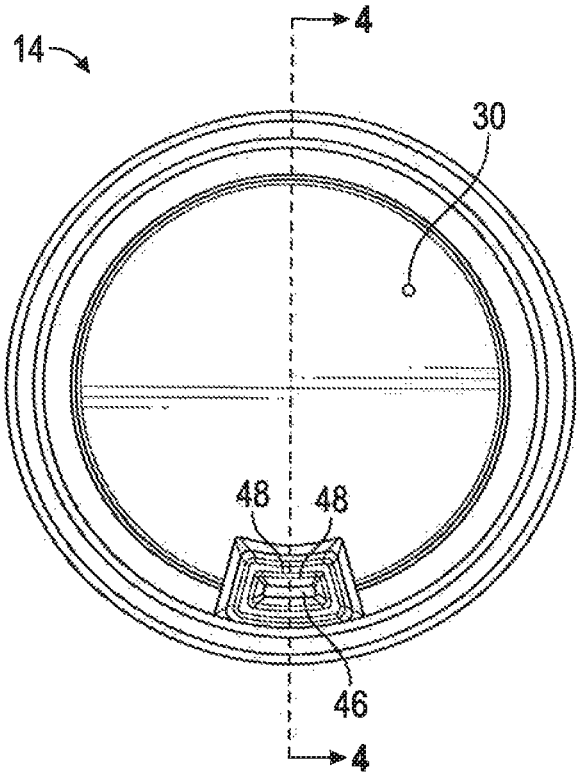
FIG. 3 is a top view of the beverage container lid of FIG. 1.
Figure 4:
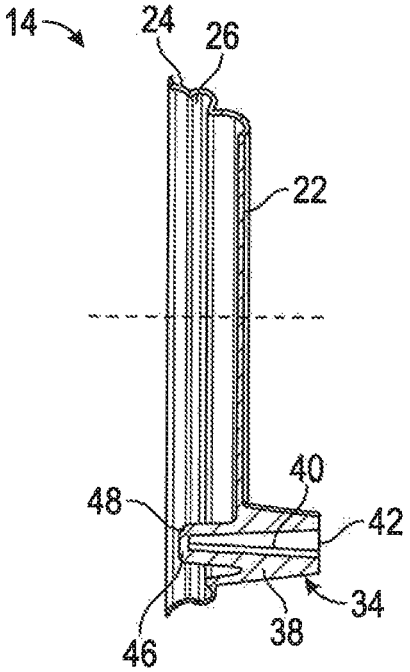
FIG. 4 is a side cross-sectional view of the beverage container lid of FIG. 1 taken along line 4-4.

Referring to FIGS. 3 and 4, the spout 34 of the lid 14 further includes an inlet portion 46 having at least one inlet perforation 48 formed therein to allow liquid 18 from the cup 12 to pass therethrough. The at least one inlet perforation 48 may be a single larger opening or a plurality of perforations. Thus, the mixing chamber 40 is disposed within the interior of the dispensing spout 34 and is fluidly connected to the at least one inlet perforation 48 and the dispensing opening 42. As an example, the lid 14 may include a single perforation or twenty (20) inlet perforations 48. When the beverage container lid 14 is secured to the cup 12, the one or more inlet perforations 48 fluidly connect the interior chamber 16 of the beverage container 12 with the mixing chamber 40 of the dispensing spout 34.

Figure 5:
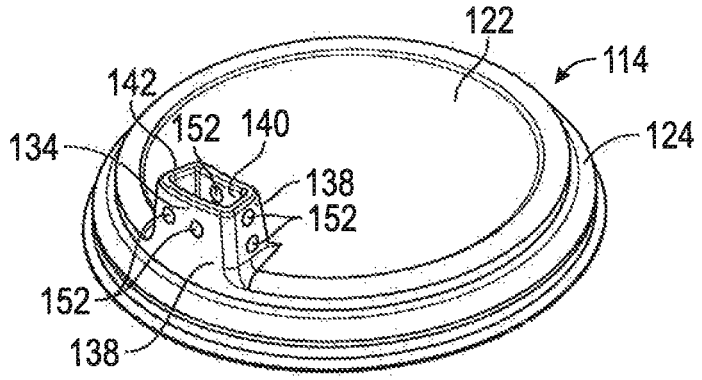
FIG. 5 is a perspective view of a beverage container lid in accordance with another embodiment.

Referring to FIG. 5, in another embodiment, wherein the like numerals represent the like elements, lid 114 includes a cover portion 122 with a flange 124 extending downwardly therefrom and a spout 134 extending upwardly therefrom. The spout 134 includes spout sides 138 forming a mixing chamber 140 and a dispensing opening 142. The dispensing spout 134 has side perforations 152 disposed on the spout sides 138 that fluidly connect the mixing chamber 140 with the atmosphere. The side perforations 152 allow air to be introduced to the mixing chamber 140 where the air mixes with the beverage prior to the beverage being consumed by the consumer. Typically, the air introduced through the side perforations 152 is cooler than the beverage, thus, thermal energy is transferred from the beverage to the introduced air, thereby cooling the beverage prior to being consumed by the drinker. The side perforations 152 may be 0.4 mm or smaller. The dispensing spout 134 may have twenty (20) side perforations 152 on each dispensing side 138. The side perforations 152 may be randomly distributed across the dispensing sides 138. In various embodiments, the side perforations may be formed on only one wall, two walls, three walls or all walls.

The ratio of beverage to air ("beverage/air ratio") within the mixing chamber 40, 140 of the spout 34, 134 may be adjusted by varying the size and/or number of the side perforations 152 and inlet perforations 148. The beverage/air ratio may also be varied by adjusting the size and/or shape of the mixing chamber 40, 140 and/or the dispensing opening 142. For example, the dispensing opening 42 may be less than 0.75 cm. In one example, the dispensing opening 42 may be 0.58 cm. Further, the inlet perforations 48 may be 0.4 mm or smaller. While the inlet perforations 48 may be larger than 0.4 mm, the more the inlet perforations 48 exceed 0.4 mm, the less able they are to prevent beverage from spilling out of the dispensing spout 34 should the cup 12 with the beverage container lid 14 attached tip over.

The beverage/air ratio may be varied according to the type of beverage. For example, when the beverage is coffee, the side perforations 52 and the inlet perforations 48 should be arranged to achieve a beverage/air ratio between 1/50 to 1/100. The minimum beverage/air ratio, for any beverage, should be no less than 1/25.

The spout 34 may extend upwardly about 2 cm, but could be extending in the range of 2 cm to 4 cm. However, other ranges would be possible.

Figure 6:
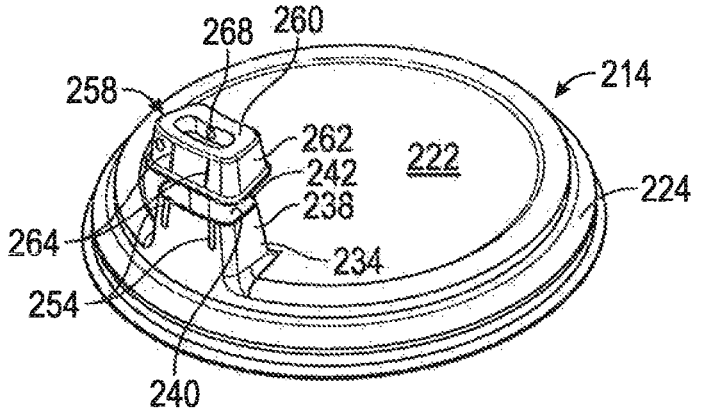
FIG. 6 is a perspective view of a beverage container lid and a mouthpiece in accordance with a further embodiment.
Figure 7:
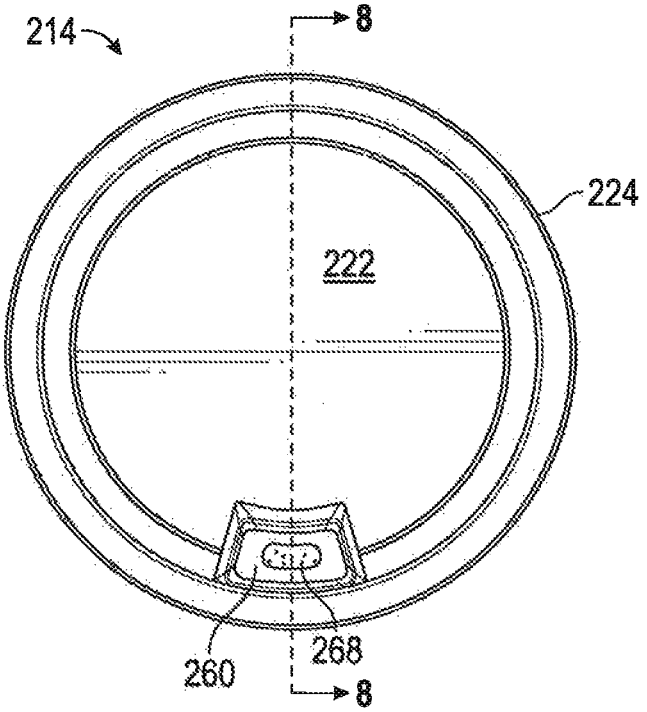
FIG. 7 is a top view of the beverage container lid with the mouthpiece of FIG. 6.
Figure 8:
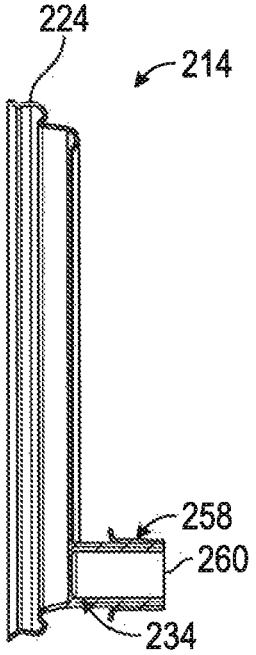
FIG. 8 is a side cross-sectional view of the beverage container lid with the mouthpiece of FIG. 6 taken along line 8-8.

Referring to FIGS. 6-8, in a further embodiment, lid 214 includes a cover portion 222 with a flange 224 extending downwardly therefrom and a spout 234 extending upwardly therefrom. The spout 234 includes spout sides 238 forming a mixing chamber 240 and a dispensing opening 242. At least one spout side 238 includes at least one rib feature 254. A mouthpiece 258 is adapted to fit over the spout 234 and includes a mouthpiece cover portion 260 with mouthpiece side walls 262 extending downwardly. The mouthpiece side walls 262 include at least one mouthpiece rib feature 264 to slidingly engage the rib feature 254 of the spout 234. The mouthpiece cover portion 260 also includes mouthpiece perforations 268 formed therein to allow liquid to pass therethrough.

Figure 9:
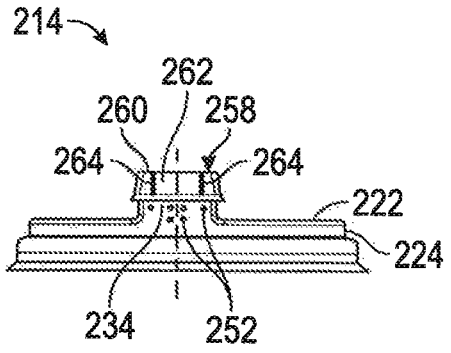
FIG. 9 is a side view of the beverage container lid with the mouthpiece of FIG. 6 in a partially engaged position.
Figure 10:
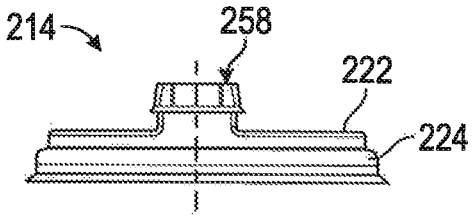
FIG. 10 is a side view of the beverage container lid with the mouthpiece of FIG. 6 in a fully engaged position.

Referring to FIGS. 9 and 10, the mouthpiece 258 may be placed onto the spout 234 of the lid 214 in either a partially engaged, shown in FIG. 9, or in the fully engaged position, shown in FIG. 10. In the partially engaged position, the mouthpiece 258 covers either no side perforations 252 or some of them. In the fully engaged position, the mouthpiece 258 may cover either all or most of the side perforations. Thus, the rib feature 264 of the mouthpiece 258 engages the rib feature 254 of the spout 234 to various degrees to provide various degree of engagement. Additionally, the length of the side walls 262 of the mouthpiece 258 may vary for the mouthpiece to be fully on or partially on depending on desired drinking temperature of the beverage.

Figure 11:
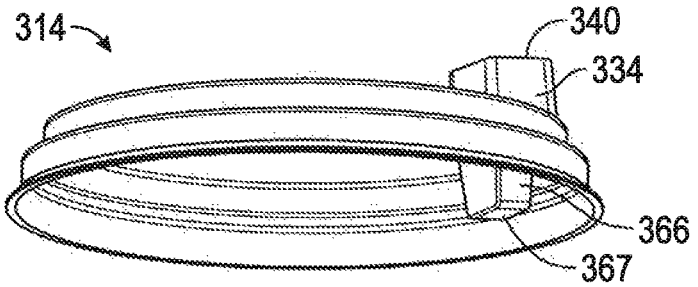
FIG. 11 is a perspective view of a beverage container lid in accordance with a further embodiment.

Referring to FIG. 11, in a further embodiment, lid 314 includes a downward spout 366 extending downwardly from the cover portion 322 of the lid 314. The downward spout includes an opening 367 to allow the liquid from the cup 12 to enter therethrough. The downward spout 366 extends the cooling channel and enlarges the mixing chamber 340 for the liquid to pass through, thereby allowing for additional dissipation of energy.

In operation, hot beverage 18 is placed into the interior chamber 16 of the beverage container cup 12. The beverage container lid 14 is then secured to the beverage container cup 12 by mating the geometry 26 of the flange 24 of the lid 14 with the rolled lip 20 of the cup 12. The vent 30 allows thermal energy, in the form of steam and/or other vapor, to escape from the contained beverage to the atmosphere. The consumer places his/her lips onto the dispensing spout 34, so that their lips cover at least the dispensing opening 42. The beverage container 12 is then tipped so that the beverage 18 in the interior chamber 16 contacts the cover 22 and the inlet portion 46. The beverage can exit the interior chamber 16 of the cup through the at least one inlet perforation 48. The beverage 18 then enters the mixing chamber 40 of the spout 34. The hot liquid cools in the mixing chamber 40 as it passes therethrough.

The sucking motion of the consumer generates a suction force that draws some of the beverage 18 contained in the interior chamber 16 of the beverage container cup 12 through the at least one inlet perforation 48 into the mixing chamber 40 of the spout 34. The hot liquid cools as it passes through the elongated mixing chamber 40 until it reaches the dispensing opening 42 to exit the lid and enter the consumer's mouth. In the embodiment with a plurality of inlet perforations 48, the beverage 18 is nebulized by the perforations 48 as the beverage passes therethrough into the mixing chamber 40. As the hot liquid passes through the multiple inlet perforations 48, it further cools in the mixing chamber 40. Besides promoting the cooling of the beverage, the inlet perforations 48 additionally reduce the amount of beverage that may spill out of dispensing spout 34 should the cup 12 with the lid 14 attached tip over.

In the further embodiment, shown in FIG. 5, the sucking motion of the consumer also draws air through the side perforations 152 into the mixing chamber 140, where the air mixes with the beverage. As the beverage mixes with the air in the mixing chamber 140, the beverage is further cooled. The beverage then continues to flow through the mixing chamber 140 until it is dispensed out of the dispensing opening 142 to the consumer.

Additionally, the vent 30, 130 may further allow air to enter the interior chamber 16 from the atmosphere, thereby equalizing any pressure differential between the interior chamber 16 of the beverage container cup 12 and the atmosphere caused by the sucking motion produced by the consumer.

The mouthpiece 258 can be placed onto the spout 234 once the beverage 18 is sufficiently cooled. The mouthpiece 258 closes side perforations 252 to minimize further rapid cooling or slow the cooling down. The mouthpiece 258 is placed on the spout 234 such that the ribs of the mouthpiece and ribs of the spout mate. Depending on how much cooling is desired, the mouthpiece can be placed in a fully engaged position or partially engaged position. In the fully engaged position, most or all side perforations 252 are closed, thereby reducing cooling effect more significantly. In a partially engaged position, none or some of the perforations are closed. Additionally, in an embodiment where the inlet perforation 48 is a single opening, the mouthpiece 258 can serve as a closing cover to minimize spillage of the beverage.

One advantage of the lid 14, 114, 214 is that it simultaneously encloses the open top of the beverage container cup 12 while permitting the hot beverage to be cooled and dispensed in a controlled manner. By cooling the hot beverage 18 prior to consumption by the consumer, the beverage container lid 14, 114, 214 reduces the likelihood that the consumer will be burned or scalded by the beverage.

Additionally, when the beverage container 10 is tipped over, the lid 14, 114, 214 reduces the amount of beverage wasted in the event of a spill.

Furthermore, the mouthpiece 258 allows for the consumer to further control the temperature of the beverage 18 by slowing and reducing the cooling process. The two positions of the mouthpiece even further control the cooling process of the beverage.

Figure 12:
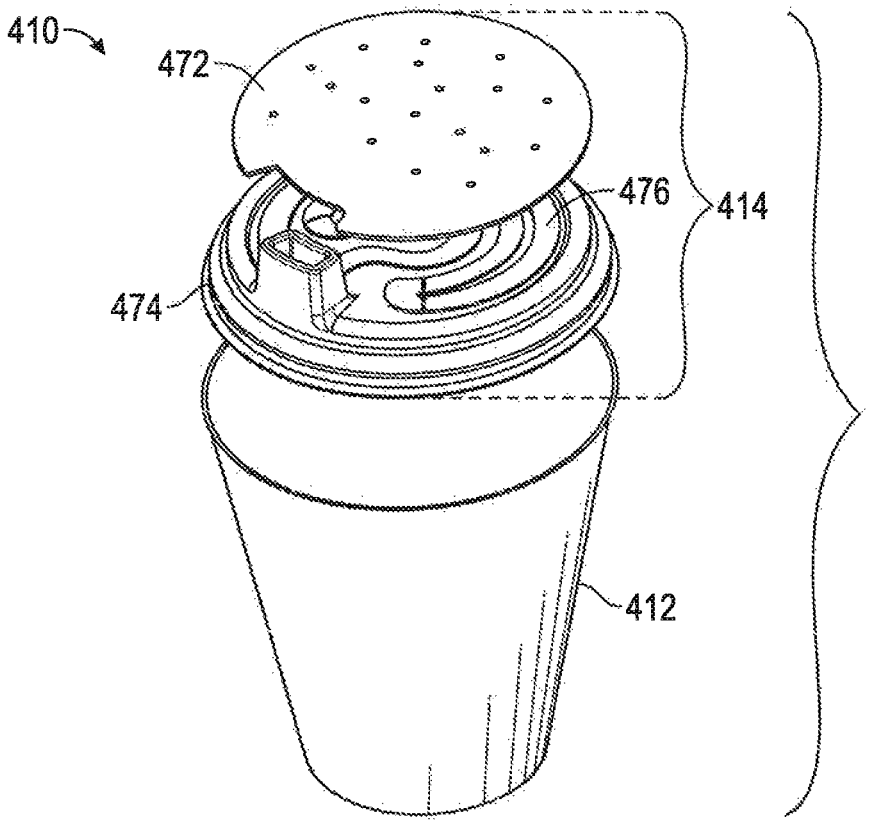
FIG. 12 is a perspective, partially exploded view of a beverage container and a lid in accordance with another further embodiment.
Figure 13:
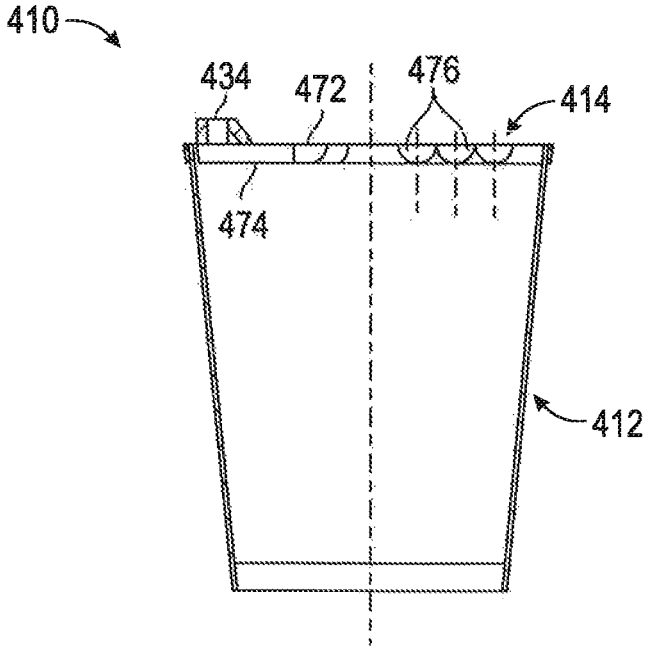
FIG. 13 is a cross-sectional view of the beverage container and the lid of FIG. 12.

Referring to FIGS. 12 and 13, in a further embodiment, lid 414 includes a cover portion 422 comprised of an upper cover 472 and a lower cover 474. The upper cover 472 and the lower cover 474 form a cooling channel 476 fluidly connected to the dispensing spout 434.

Figure 14:
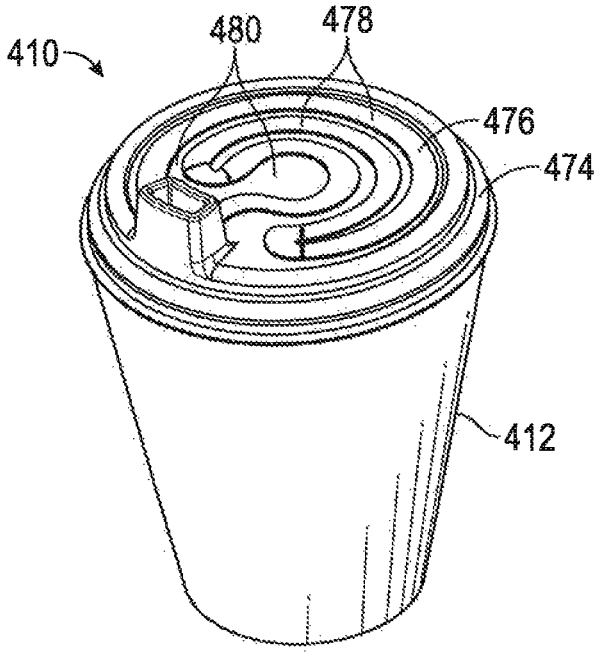
FIG. 14 is a perspective view of the beverage container and the lid of FIG. 12 without the top cover.
Figure 15:
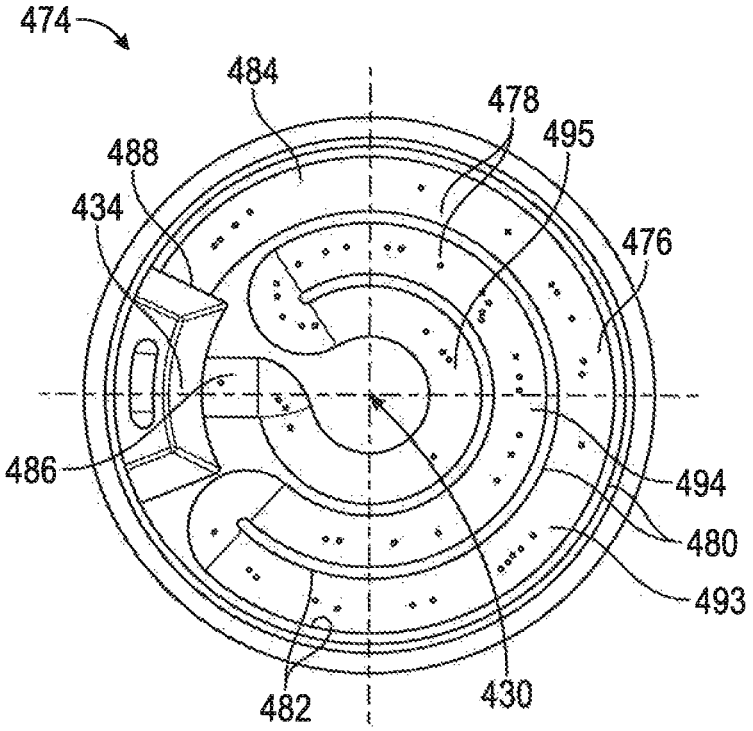
FIG. 15 is a top view of the beverage container and the lid of FIG. 14.

Referring to FIGS. 14 and 15, the lower cover 474 includes depressed portions 478 and non-depressed portions 480. The depressed portions 478 extend downwardly from the non-depressed portions 480 and form sidewalls 482 and a floor 484 of the cooling channel 476. The lower cover 474 further includes an outlet opening 486 that fluidly connects the cooling channel 476 to the dispensing spout 434. The cooling channel further includes a channel inlet 488 for allowing the beverage to flow into the channel 476.

Figure 16:
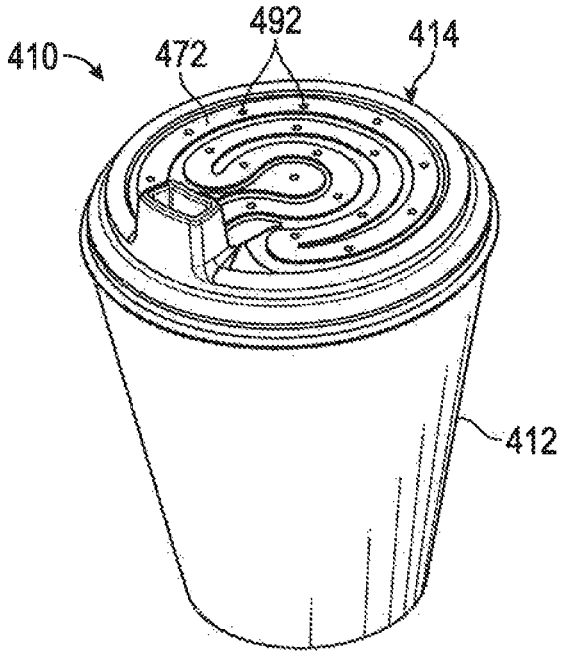
FIG. 16 is a perspective view of the beverage container and the lid of FIG. 12 with the top cover.
Figure 17:
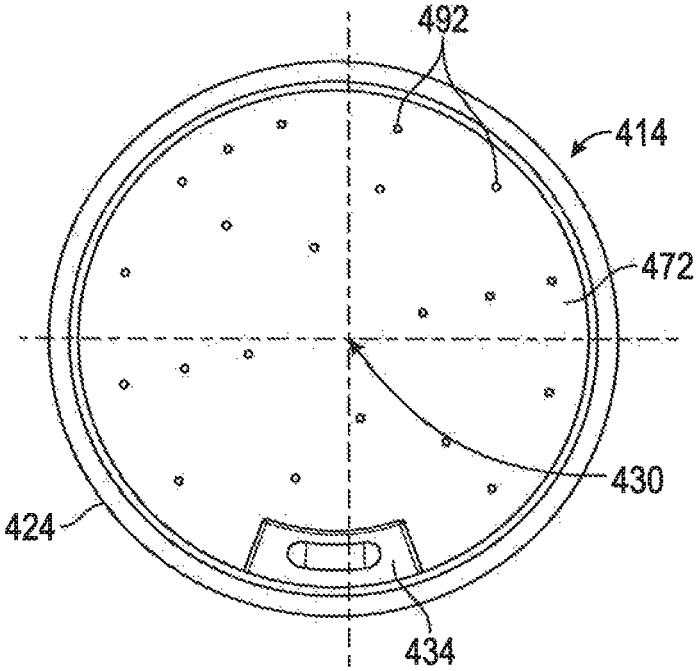
FIG. 17 is a top view of the beverage container and the lid of FIG. 16.

Referring to FIGS. 16 and 17, the upper cover 472 is attached to the lower cover 474 such that the upper cover 472 forms a ceiling 490 of the cooling channel 476. The upper cover 472 seals the cooling channel 476 and prevents beverage flowing through the cooling channel 476 from spilling out of the cooling channel 476. The upper cover 472 may include one or more upper cover perforations 492. The one or more upper cover perforations 492 allow ambient air to contact beverage contained within the cooling channel 476. The one or more upper cover perforations 492 may be 0.1 mm in width and dispersed over the upper cover 472. As an example, when the upper cover 472 includes one or more perforations 492, the channel inlet 488 and the outlet opening 486 could be approximately 0.58 cm.

The cooling channel 476 may be generally not greater than 0.5 cm in width and the channel inlet 488 should be 0.24 cm in width. To provide for a maximum length for the cooling channel 476, the channel inlet opening 488 is located near or adjacent to the vicinity of the outlet opening 486.

The cooling channel 476 should be of a length that allows sufficient time for the beverage flowing through the cooling channel 476 to dissipate thermal energy so that the beverage sufficiently cools. For example, the cooling channel 476 may have a length of approximately 37 cm. To achieve such a length, the cooling channel 476 may have a spiral serpentine configuration having one or more portions 493, 494 and 495 that fold back onto themselves, as best seen in FIG. 15. For example, the cooling channel 476 may have an outer "C" shaped portion 493 along the outer portion of the lower cover 474. The outer "C" shaped portion 493 encircles and is fluidly connected to the channel inlet 488 and follows the outer perimeter of the lower cover 474. The cooling channel 476 then turns onto itself so that a middle "C" shaped portion 494 is established adjacent to, and nested within, the outer "C" shaped portion 493. The middle "C" shaped portion 494 has a "C" shaped profile of a smaller size than the outer "C" shaped portion 493. The middle "C" shaped portion 494 follows the outer "C" shaped portion 493. The cooling channel 476 then turns onto itself again so that an inner "C" shaped portion 495 is established, adjacent to, and nested within, the middle "C" shaped portion 494. The inner "C" shaped portion 495 has a "C" shaped profile of a smaller size than the middle "C" shaped portion 494. The inner "C" shaped portion 495 is fluidly connected to the dispensing spout 434 via the outlet opening 486.

The cooling channel 476 can be either a singular channel or be formed by several distinct channels (not shown). Additionally, the cooling channel 476 may have a shape, other than the spiral serpentine configuration described above, that has separate traversing channels that run adjacent to one other and form a spiral type configuration. Such a shape may include linear shaped passageways with turning corners. However, although other shapes are feasible, the spiral serpentine configuration described above maximizes distance between the channel inlet 488 and the outlet opening 486, thereby, optimizing cooling of the beverage.

The vent 430 may be centered or offset such that the vent penetrates both the upper cover 472 and the lower cover 474, thereby exposing the interior chamber 416 of the beverage container 412 to the atmosphere.

The upper cover 472 may be fabricated from a material that accentuates the dissipation of heat from beverage contained in the cooling channel 476 via conduction. For example, the upper cover 472 may be fabricated from metal foil, plastic-mesh-like material or other material conducive to conducting heat.

In operation, referring back to FIG. 15, the channel inlet opening 488 allows beverage from the interior chamber 416 of the beverage container 412 to flow into the cooling channel 476. The beverage flows through the cooling channel 476 to the dispensing spout 434 via the outlet opening 486. Accordingly, the cooling channel 476 allows beverage to flow from the interior chamber 416 of the beverage container 412 via the channel inlet 488 to the dispensing spout 434 via the outlet opening 486 whereupon the beverage is dispensed to the consumer. As the beverage passes through the cooling channel 476, it is cooled. The liquid may be further cooled by the perforations 492.

As the upper cover 472 seals the cooling channel 476, the cooling channel 476 operates as a straw. When the consumer generates the sucking motion, some of the beverage contained within the interior chamber 416 of the beverage container 412 is drawn into the inlet opening 488 and flows through the cooling channel 476 and is dispensed out the dispensing opening 442 of the dispensing spout 434. As the beverage flows through the cooling chamber 476, the beverage looses thermal energy that is dissipated though the upper cover 472 and sidewalls and/or floor of the cooling channel 476. For example, the beverage may enter the inlet opening 488 with an initial temperature between 160° F. and 195° F. and exit the dispensing spout 434 with a temperature between about 135° F. and 145° F.

Figure 18:
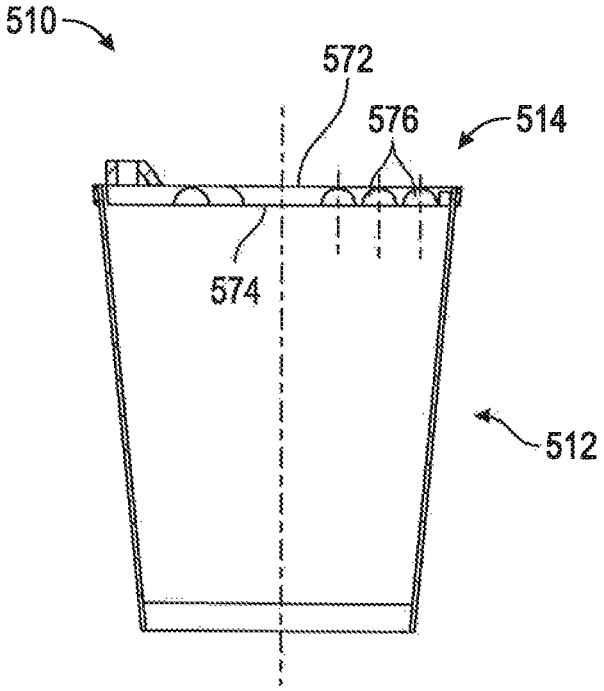
FIG. 18 is a cross-sectional view of the beverage container and the lid according to another embodiment.

Referring to FIG. 18, in a further embodiment, lid 514 may include an upper cover 572 and a lower cover 574 such that the upper cover includes a cooling channel 576 formed therein. Thus, the upper cover 572 may have raised portions and non-raised portions that define the sidewalls and ceiling of the cooling channel 58 and the lower cover 574 may define the floor of the cooling channel 576.

Although the lid and mouthpiece have been shown and described with respect to detailed embodiments thereof, it will be understood by those skilled in the art that various changes in form and detail thereof may be made without departing from the spirit and the scope of the disclosure.

For example, the lid-mating portion and the container-mating portion may be any type of container to lid mating device(s). In particular, the container-mating portion may be a rolled lip 20 and the lid-mating portion may be a downward extending flange 24 securing the beverage container lid to the open top of the beverage container by flexing around the container-mating portion and then rebounding to form a secure connection. However, other engagement mechanisms are within the scope of the present disclosure.

Additionally, although the beverage discussed above has a hot temperature while in the interior chamber 16 of the beverage container 12, the beverage may have a cold temperature while in the interior chamber 16.

Moreover, the lid may have the cooling channel 476, but not have the side perforations 152 and/or inlet perforations 48. Conversely, the beverage container lid may have the side perforations 152 or the inlet perforations 48, but not have the cooling channel 476. Similarly, the lid may have either side perforations 152 or the inlet perforations 48 or both.

Additionally, it is also to be understood that the terminology used is for the purpose of describing particular embodiments only, and is not intended to limit the scope of the claims of the present application.

What is claimed is:

1. A beverage container lid for dispersing heat comprising:

a cover portion having at least one inlet perforation and a dispensing spout extending upwardly therefrom, the spout having spout sides to form a mixing chamber with a dispensing opening;

wherein at least some of the beverage contained in an interior chamber of a beverage container is drawn through the at least one inlet perforation into the mixing chamber and is dispensed through the dispensing opening such that the at least some of the beverage exiting through the dispensing opening has a lower temperature than the beverage contained in the interior chamber of the beverage container; and wherein at least one of the spout sides has one or more side perforations for allowing air to enter the mixing chamber to cool at least some of the beverage in the mixing chamber while the beverage is being dispensed from the dispensing opening to a mouth of a consumer, such that the beverage cools as it passes through the mixing chamber.

2. The beverage container lid according to claim 1, wherein the at least one inlet perforation nebulizes the at least some of the beverage prior to the at least some of the beverage entering the mixing chamber.

3. The beverage container lid according to claim 1, wherein the at least one inlet perforation is a plurality of inlet perforations.

4. The beverage container lid according to claim 1, wherein the ratio of the at least some of the beverage to air within the mixing chamber is within the range of 1/50 to 1/100.

5. The beverage container lid according to claim 1, wherein the ratio of the at least some of the beverage to air within the mixing chamber is not less than 1/25.

6. The beverage container lid according to claim 1, wherein at least one of the dispensing sides has a plurality of side perforations.

7. The beverage container lid according to claim 6, wherein at least one of the side perforations is 0.4 mm or smaller.

8. The beverage container lid according to claim 1, wherein at least one of the dispensing sides has at least twenty side perforations.

9. The beverage container lid according to claim 1, further comprising a mouthpiece adapted to be placed onto the spout to reduce cooling of the beverage.

10. The beverage container lid according to claim 9, wherein the mouthpiece fully or partially engages the spout and includes at least one mouthpiece perforation to allow beverage to exit therefrom.

11. The beverage container lid according to claim 1, further comprising a downward spout extending downwardly from the cover portion.

12. The beverage container lid according to claim 1, wherein the one or more side perforations fluidly connect the mixing chamber with atmosphere.

13. The beverage container lid according to claim 1, wherein the at least one inlet perforation is configured so that the at least some of the beverage drawn through the at least one inlet perforation into the mixing chamber is drawn via a suction force generated by the consumer.

14. A beverage container lid for dispersing heat comprising:

a lower cover;

an upper cover attached to the lower cover and forming a cooling channel therebetween, the cooling channel having a channel inlet for allowing fluid to enter the cooling channel and an outlet opening allowing the fluid to exit the cooling channel; and a spout extending upwardly from the lid and defining a dispensing opening, the spout being fluidly connected to the cooling channel via the outlet opening;

wherein at least some of the beverage contained in an interior chamber of a cup is drawn into the channel inlet, flows through the cooling channel and through the outlet opening into the spout, and then is dispensed through the dispensing opening of the spout such that the at least some of the beverage has a lower temperature than the beverage contained in the interior chamber of the cup;

wherein the cooling channel has a spiral serpentine configuration; and wherein the upper cover has one or more cooling perforations with each cooling perforation having a first end in contact with the cooling channel and a second end in contact with atmosphere for allowing air to enter the cooling channel to cool at least some of the beverage in the cooling channel while the beverage is being dispensed from the outlet opening to a mouth of a consumer, such that the beverage cools as it passes through the cooling channel.

15. The beverage container lid according to claim 14, wherein the upper cover comprises foil.

16. The beverage container lid according to claim 14, wherein the spout defines a mixing chamber.

17. The beverage container lid according to claim 14, wherein the spout includes spout sidewalls having side perforations.

18. A beverage container lid for dispersing heat comprising:

a cover portion having at least one inlet perforation and a dispensing spout extending upwardly therefrom, the spout having spout sides to form a mixing chamber with a dispensing opening, at least one of spout sides having one or more side perforations for allowing air to enter the mixing chamber to cool at least some of the beverage in the mixing chamber;

wherein at least some of the beverage contained in an interior chamber of a beverage container is drawn through the at least one inlet perforation into the mixing chamber and is dispensed through the dispensing opening such that the at least some of the beverage exiting through the dispensing opening has a lower temperature than the beverage contained in the interior chamber of the beverage container due to air entering the mixing chamber to cool at least some of the beverage in the mixing chamber while the beverage is being dispensed from the dispensing opening to a mouth of a consumer, such that the beverage cools as it passes through the mixing chamber.

19. The beverage container lid according to claim 18, wherein the at least one inlet perforation nebulizes the at least some of the beverage prior to the at least some of the beverage entering the mixing chamber.

* * * * *